US005351850A

United States Patent [19]

Brieskorn

[11] Patent Number: 5,351,850

[45] Date of Patent: Oct. 4, 1994

[54] DOUBLE-WALLED BARREL AND METHOD OF ITS MANUFACTURE

[75] Inventor: Günter Brieskorn, Neustadt/Weinstr., Fed. Rep. of Germany

[73] Assignee: Rheinpfälzische Emballagenfabrik G. Schönung GmbH & Co. KG, Neustadt/Weinstrasse, Fed. Rep. of Germany

[21] Appl. No.: 943,775

[22] Filed: Sep. 11, 1992

[30] Foreign Application Priority Data

Sep. 25, 1991 [DE] Fed. Rep. of Germany ..... 4131899

[51] Int. Cl.[5] ..... B65D 90/04

[52] U.S. Cl. ..... 220/466; 220/254; 220/256

[58] Field of Search ..... 220/466, 254, 256

[56] References Cited

U.S. PATENT DOCUMENTS

| | | | |
|---|---|---|---|
| 1,800,082 | 4/1931 | Knigge | 220/466 |
| 2,080,326 | 5/1937 | Maddock | 220/466 |
| 2,243,164 | 5/1941 | Maddock | 220/466 |
| 2,249,051 | 7/1941 | Schulse | 220/460 |

*Primary Examiner*—Joseph Man-Fu Moy
*Attorney, Agent, or Firm*—Collard & Roe

[57] ABSTRACT

A double-walled barrel and method of manufacture including a cylindrical barrel jacket with a first set of corrugations, having a top with barrel openings and a bottom attached to the cylindrical barrel jacket by a first set of folds forming an outer barrel. A steel container with an inner top with barrel openings and an inner bottom attached to the container by a second set of folds forming an inner barrel. The inner barrel is configured and dimensioned to closely fit within the outer barrel. The inner top is joined to the top.

4 Claims, 2 Drawing Sheets

DOUBLE-WALLED BARREL AND METHOD OF ITS MANUFACTURE

BACKGROUND OF THE INVENTION

1. Field of the Invention

The present invention relates to a double-walled barrel and a method for manufacturing the double-walled barrel. More specifically, the double-walled barrel includes a cylindrical barrel jacket into which a steel container is inserted.

2. The Prior Art

The Germany Patent DE-OS 2 134 034, discloses a steel barrel in which the bottom and top of the barrel are connected to a barrel jacket by a multiple fold. These barrels are manufactured as standard 55 gallon barrels as disclosed in European patent EP-OS 0 162 873. These barrels are used for transporting goods which pose an environmental hazard. Through a special process these barrels can be designed to meet the ISO-container requirements, so that the ISO-container can be fitted with these barrels. However, the safety requirements, which become increasingly stricter, lead to the manufacture of steel or stainless steel barrels for container hazardous materials. However, hazardous materials such as, for example, oils, paints, lacquers, emulsions, dilutes and others may not be stored in such barrels. In order to store these items, the barrels must be arranged in conventional collecting tubs, for example, barrel stacking pallets. A draw-back exists in that this arrangement is costly. In addition, the manageability and mobility of the individual barrel has been eliminated.

An attempt to solve the above referenced problem was made by constructing double-walled barrels, in which a plastic container is placed within a standard steel barrel. However, this type of double-walled barrel is not suitable for containing all types of goods, particularly those reacting with plastic. Also, the temperature and chemical properties of the materials to be contained must be considered. Although, these barrels may be used to ship certain materials, additional measures must be taken if they are to be used as storage barrels. In addition, the inner plastic container is not self-supporting but is supported by the outer metal sleeve.

SUMMARY OF THE INVENTION

It is the purpose of the invention to provide a double-walled barrel and method for its manufacture, which overcomes the deficiencies of the prior art, which can be used for both shipping and storage.

It is another object of the present invention to provide a double-walled barrel for intermediate and long range storage of environmentally hazardous materials with a high degree of stability.

These and other related objects are achieved according to the invention by a double-walled barrel and method for its manufacture, including a cylindrical barrel jacket with a first set of corrugations having a top and a bottom. The top and bottom are attached to the cylindrical barrel by a first set of folds forming an outer barrel. The top of the barrel jacket has barrel openings therein. A steel container having an inner top and an inner bottom attached to the container by a second set of folds forms an inner barrel. The inner barrel is configured and dimensioned to fit within the outer barrel. The inner top is joined to the barrel jacket top.

The steel container has a second set of corrugations which along with the second set of folds are supported against the inner surface of the cylindrical barrel jacket. The top and the inner top are joined together by a connecting flange which forms the barrel openings. Alternatively, the top can be welded to the inner top.

A method for manufacturing the steel barrel includes the steps of inserting a steel container having an inner top and an inner bottom attached thereto by folds into a close fitting barrel jacket having a bottom attached thereto by folds. A top of the barrel jacket is joined to the inner top. The top is attached to the barrel by folds. Alternatively, the top and inner top may first be joined before insertion of the inner barrel into the outer barrel.

The barrel according to the invention provides a double-walled corrugated barrel which meets the highest safety requirements for shipping and storing environmentally hazardous materials. Due to the close fit of the steel container within the cylindrical barrel jacket, the steel container is tightly seated. The barrel as a result satisfies the required drop tests and inside pressure load tests. Conventional equipment and plants can be used to manufacture the barrel according to the invention.

Surprisingly it was found, that the barrel according to the invention can be manufactured from two barrels meeting DIN standards. The cylindrical barrel jacket can be constructed from a 55 U.S. gallon barrel according to DIN 6643 and the steel container according to the same standard, but with a slightly reduced outer dimension. Due to the design to the top and inner top of the barrel in the region of the barrel openings, a connection with automatic filling and cap screwing equipment is assured. Furthermore, due to an alternate embodiment of the top and inner top in the region of the barrel openings, the actual closure is relieved when loaded. In addition, due to the interior shape of the top and the inner top in the region of the barrel openings, the barrel can be completely emptied.

The method for manufacturing a double-walled barrel according to the invention can be used to re-condition used steel barrels to obtain double-walled barrels.

BRIEF DESCRIPTION OF THE DRAWINGS

Other objects and features of the present invention will become apparent from the following detailed description considered in connection with the accompanying drawings which discloses two embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
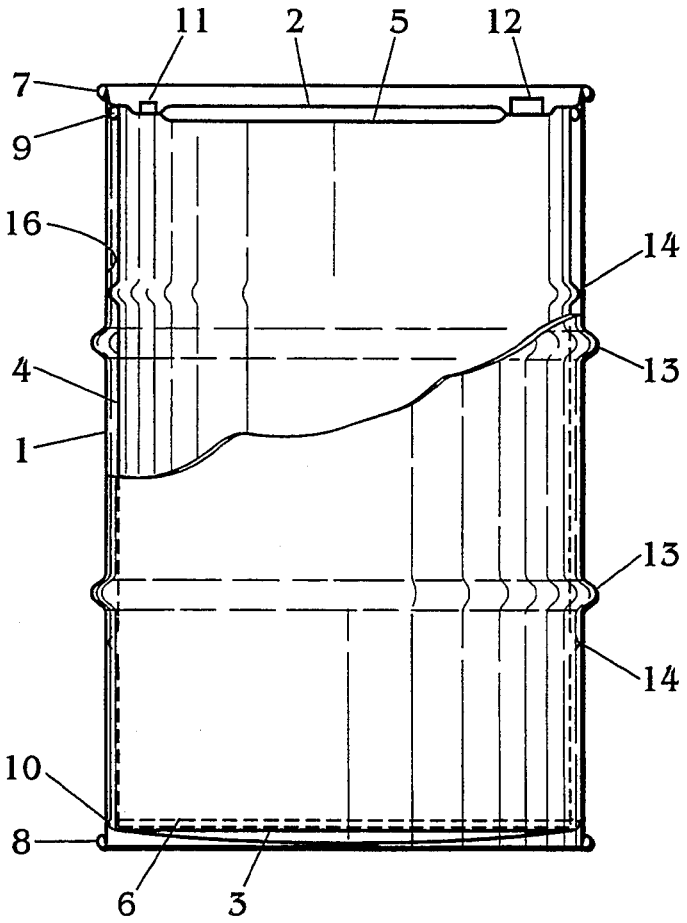
FIG. 1 is a side elevational view in part cross-section of a double-walled barrel according to the invention.
Figure 2:
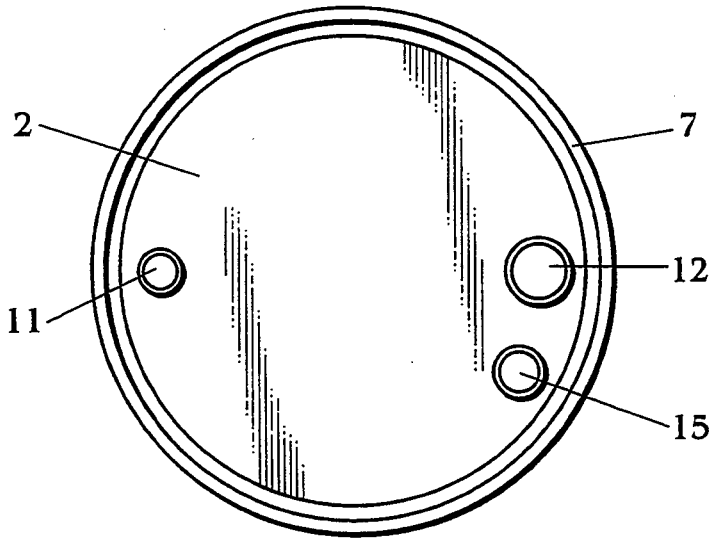
FIG. 2 is a top plan view of the barrel.

Referring now to the drawings and in particular to FIGS. 1 and 2, there is shown a cylindrical barrel jacket 1, having a top 2 and a bottom 3. Top 2 and bottom 3 are connected to cylindrical barrel jacket 1 by folds 7 and 8, respectively. Cylindrical barrel jacket 1 is provided with a first set of corrugations 13, which also serve as rolling beads.

Located within cylindrical barrel jacket 1 is a correspondingly shaped steel container 4 having an inner top 5 and an inner bottom 6. Inner top 5 and inner bottom 6 are attached to steel container 4 with folds 9 and 10, respectively. Barrel openings 11 and 12 pass through concentric holes in top 2 and inner top 5. Test opening 15 passes through top 2 only. Steel container 4 is provided with a second set of corrugations 14. The widest part of corrugations 14 is supported against an inside 16 of cylindrical barrel jacket 1. The widest part of folds 9 and 10 is also supported against inside 16 of cylindrical barrel jacket 1.

Figure 3:
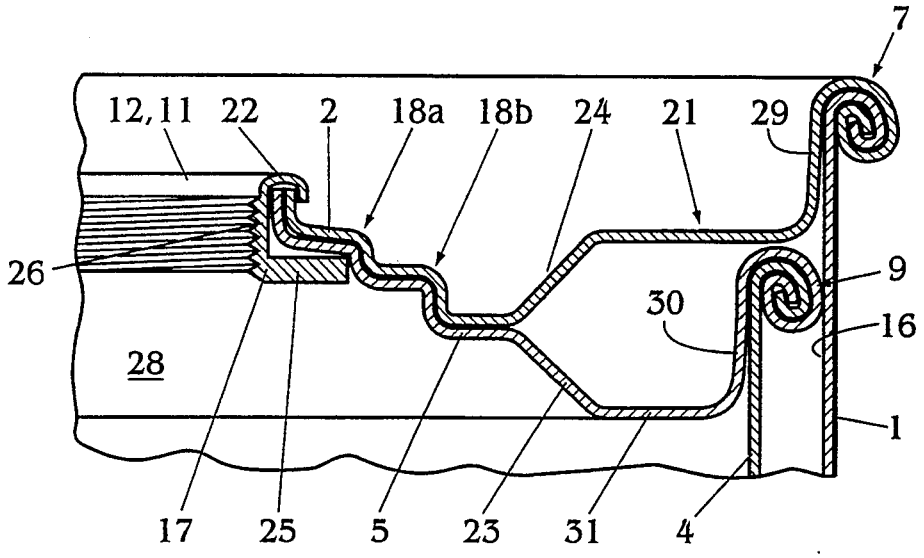
FIG. 3 is a cross-sectional view of the top of the barrel in the region of a barrel opening.
Figure 4:
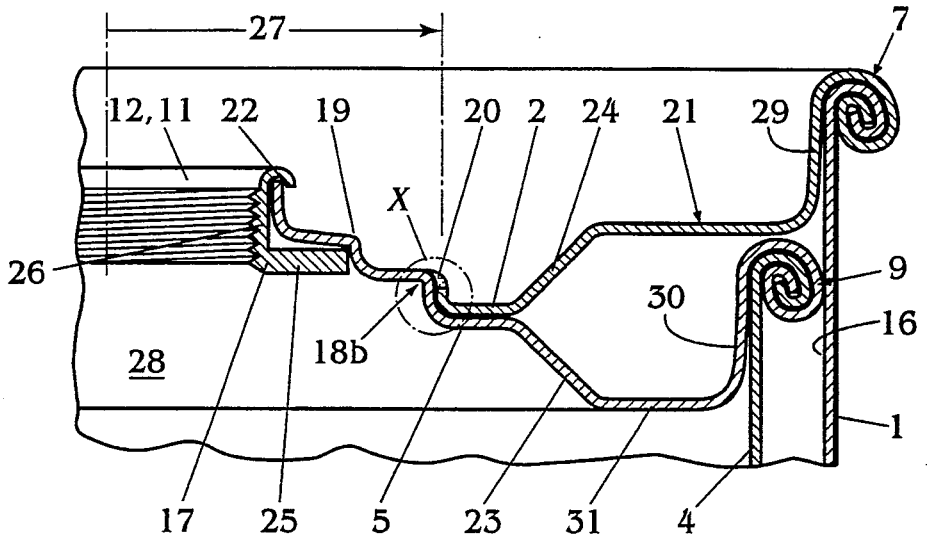
FIG. 4 is a cross-sectional view of an alternate embodiment of the top of the barrel and a barrel opening.

As can be seen in FIGS. 3 and 4, top 2 of cylindrical barrel jacket 1 and inner top 5 of steel container 4 are joined in the region of barrel openings 11 and 12. Top 2 extends downwardly from fold 7 along a rim 29 to a first level 21 which rests on top of fold 9 between steel container 4 and inner top 5. Rim 29 is parallel and adjacent to barrel jacket 1 and forms approximately a 90° angle with first level 21, for example. First level 21 extends over a majority of top 2, as can be seen in FIG. 1. Also, first level 21 rests on top of fold 9 along the entire perimeter of inner top 5. In the vicinity of a barrel opening 11 or 12, first level 21 slants into a downwardly angled section 24. Directly beneath first level 21, inner top 5 extends downwardly from fold 9 along a rim 30 to a first inner level 31. Rim 30 is parallel and adjacent to steel container 4 and forms approximately a 90° angle with first inner level 31, for example. First level 21 and first inner level 31 are parallel to each other. Below downwardly angled section 24, inner top 5 forms an upwardly angled section 23 so that top 2 and inner top 5 meet. As can be seen in FIG. 3, from this point in toward barrel openings 11 and 12, top 2 conforms to the shape of inner top 5. Top 2 and inner top 5 form steps **18*a* and 18*b* which extend upwardly to barrel openings 11 and 12**.

At barrel opening 11 and 12 a connecting flange 17 is provided with an outwardly extending disk 25 which rests against the underside of inner top 5. A cylindrical channel 26 extends upwardly from disk 25 forming barrel opening 11 or 12. Cylindrical channel 26 is oriented perpendicular to disk 25. The upper most portion of cylindrical channel 26 includes a bead 22 which is folded outwardly from barrel opening 11 and 12 over the upwardly turned edges of top 2 and inner top 5. Bead 22 which extends outwardly from barrel openings 11 and 12 will not interfere with threads along the inner portion of cylindrical channel 26 onto which a cap may be screwed. Also, bead 22 forms a seal between top 2 and inner top 5 preventing foreign objects from entering between the tops. A test opening 15 may be provided in top 2 which would provide access between top 2 and inner top 5 to test the integrity of the double barrel.

Figure 5:
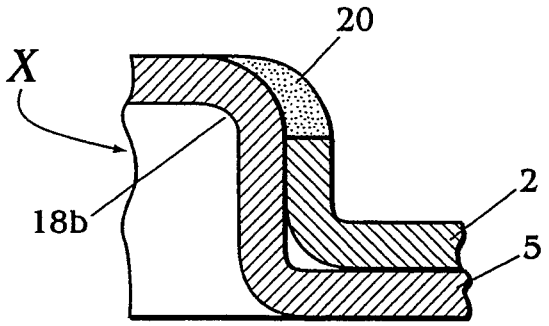
FIG. 5 is an enlarged view of area X from FIG. 4.

An alternate embodiment of the barrel can be seen in FIGS. 4 and 5. This design is similar to that of FIG. 3 except that top 2 is provided with a cut-out 19, for example, a circular cut-out. Cut-out 19 has a radius 27 larger than the radius of barrel opening 11 or 12, for example, which extends to step **18*b*. FIG. 5 shows an enlarged view of step 18*b*, where top 2 is attached to inner top 5 by a welded seam 20. Welded seam 20 prevents foreign matter from entering between top 2 and inner top 5. As can be seen in FIG. 2, a test opening 15 can be placed into top 2 to allow access between top 2 and inner top 5 to test the integrity of the double barrel. Bead 22 engages the up-turned edge of inner top 5 only. As can be appreciated from FIGS. 3 and 4, the inner contours of inner top 5 and barrel opening 11 and 12 are the same for both embodiments. From inside container 4, designated by interior 28, material can easily flow out of container 4 if it were inverted. Beyond first inner level 31, upwardly angled section 23, and steps 18*a* and 18*b* are angled toward opening 11 or 12. Thus a liquid material would easily and completely flow out of container 4**.

A standard 55 U.S. gallon barrel designed according to DIN 6643 can be manufactured to meet or fall short of the ISO-container requirements. A double barrel to be used in place of the standard 55 U.S. gallon barrel requires an outer barrel to be made with dimensions according to DIN 6643. The inner barrel must also comply with the DIN standard 6643, but with reduced dimensions.

The method for manufacturing a double-walled barrel according to the invention involves completely assembling the inner barrel including steel container 4, inner top 5 and inner bottom 6 with folds 9 and 10. The cylindrical barrel jacket 1 is attached to bottom 3 by fold 8. Top 2 is then connected to inner top 5 by passing cylindrical channel 26 through the barrel openings 11 and 12 in both top 2 and inner top 5 from the inside of steel container 4. Disk 25 is brought in contact with the bottom of inner top 5. Bead 22 is subsequently folded over the upwardly extending edges of top 2 and inner top 5 to join them together. Next, steel container 4 is placed into cylindrical barrel jacket 1 and top 2 is connected to cylindrical barrel jacket 1 with fold 7. Alternatively, steel container 4 can first be placed into barrel jacket 1 and then top 2 can be attached to inner top 5 and barrel jacket 1. To manufacture the embodiment shown in FIGS. 4 and 5, top 2 is joined to inner top 5 by welding instead of by bead 22 of connecting flange 17.

While several embodiments of the present invention have been shown and described, it is to be understood that many changes and modifications may be made thereunto without departing from the spirit and scope of the invention as defined in the appended claims.

What is claimed is:

1. A double-walled barrel comprising:

an outer barrel including (a) a cylindrical barrel jacket with an inner surface and a first set of corrugations; and (b) a top with barrel openings and a bottom, said top and bottom being attached to said cylindrical barrel jacket by a first set of folds to form said outer barrel;

an inner barrel including:

(a) a steel container having a second set of corrugations; and (b) an inner top with barrel openings and an inner bottom, said inner top and inner bottom being attached to said container by a second set of folds to form said inner barrel, said inner barrel being configured and dimensioned to closely fit within said outer barrel and being supported by said second set of folds and said second set of corrugations lying against the inner surface of said cylindrical barrel jacket;

a connecting flange, said inner top extending upwardly toward said top and contacting said top in a region of the barrel openings, said top conforming to the shape of said inner top and being joined to said inner top by said connecting flange at the barrel opening;

wherein the region of contact between said top and said inner top is step-shaped with the steps progressing upwardly, in a direction away from said bottom, toward the barrel opening.

2. The double-walled barrel according to claim 1, wherein said top includes a test opening.

3. The double-walled barrel according to claim 2, wherein said outer barrel is a standard 55 U.S. gallon barrel and said inner barrel is a standard inner barrel with smaller dimensions than said outer barrel.

4. The double-walled barrel according to claim 3, wherein said outer barrel and said inner barrel are made according to DIN 6643.

* * * * *